US007635151B2

(12) United States Patent
Rodawold, Jr. et al.

(10) Patent No.: US 7,635,151 B2
(45) Date of Patent: Dec. 22, 2009

(54) RELEASE HANDLE WITH INTEGRATED INERTIA LOCKING MECHANISM

(75) Inventors: Joseph L. Rodawold, Jr., Wilmington, IL (US); Craig W. Gurtatowski, Crown Point, IN (US)

(73) Assignee: Illinois Tool Works Inc., Glenview, IL (US)

( * ) Notice: Subject to any disclaimer, the term of this patent is extended or adjusted under 35 U.S.C. 154(b) by 99 days.

(21) Appl. No.: 11/449,224

(22) Filed: Jun. 8, 2006

(65) Prior Publication Data

US 2007/0284894 A1 Dec. 13, 2007

(51) Int. Cl.
*E05B 3/00* (2006.01)
*E05B 65/10* (2006.01)

(52) U.S. Cl. ..... 292/336.3; 292/DIG. 22

(58) Field of Classification Search ..... 292/DIG. 22, 292/92, 93, 336.3, DIG. 65
See application file for complete search history.

(56) References Cited

U.S. PATENT DOCUMENTS 3,601,434 A * 8/1971 Fargo et al. ..... 292/50
5,769,471 A * 6/1998 Suzuki et al. ..... 292/336.3
2005/0184537 A1* 8/2005 Le et al. ..... 292/336.3

FOREIGN PATENT DOCUMENTS

DE 19858414 A1 * 6/2000
EP 1128004 A2 * 8/2001

* cited by examiner

*Primary Examiner*—Peter M Cuomo
*Assistant Examiner*—Alyson M Merlino
(74) *Attorney, Agent, or Firm*—Mark W. Croll; Paul F. Donovan

(57) ABSTRACT

An integrated inertia locking mechanism may be incorporated with a door handle assembly and is particularly beneficial in acceleration events, such as a multiple axis crash, by counteracting the forces of inertia caused by such crash. In an exemplary aspect, the integrated inertia locking mechanism will prevent the door latch mechanism, which releases the door, from releasing and the door opening during a multiple axis crash. After the crash, or when the crash force is removed, the integrated inertia locking mechanism will allow the latch mechanism to function normally, thereby permitting the door to be opened and the occupants to exit from the vehicle.

17 Claims, 6 Drawing Sheets

RELEASE HANDLE WITH INTEGRATED INERTIA LOCKING MECHANISM

FIELD OF THE INVENTION

The present invention relates generally to a mechanism that resists the unlatching of a door of a vehicle if the vehicle is involved in a crash.

BACKGROUND OF THE INVENTION

There is a current trend in the vehicle manufacturing industry to equip vehicles with doors having pull-style release handles. A pull-style release handle is a handle that can be actuated by the operator by simply pulling in one direction, typically outward. Pull-style handles are replacing the previously used push button release and lift-style handles. A push button release handle includes a button that the operator pushes to unlatch and thus open the vehicle door. A lift-style handle is one that is actuated by lifting a pivoting mechanism both outward and upward to open the door.

Vehicle door release systems, such as release handles, must meet certain safety and performance requirements particularly when subjected to high acceleration events, such as a vehicle crash. These requirements specify that handles must remain closed in these high acceleration events so as to prevent inadvertent actuation of the door latch and unwanted opening of the door. Inertial properties in handles are such that the tendency is for handles to open when subjected to high acceleration events, for example, during a multiple axis vehicle crash such as a vehicle rollover. A roll-over vehicle crash is just one example where very high acceleration forces can be generated in various axes at the same time.

Vehicle makers currently prevent this unwanted opening of the handles by employing various devices to counter the forces generated by high accelerations caused in a vehicle crash. As an example, known protection systems employ a counter-mass mounted on a pivoting link attached to the release handle. These known systems have certain limitations and drawbacks. One such limitation is that the counter-mass and associated components require a significant amount of space, known as package space. Another significant limitation is that counter-mass protected systems only perform up to a predetermined acceleration force. If the forces during a crash exceed the predetermined acceleration, the counter-mass will no longer prevent the handle from opening and actuating the latch. Yet another limitation is that counter-mass protected systems do not perform as well when the accelerations occur in multiple axes. In some instances, forces on the counter-mass due to acceleration may cause the counter-mass to react in a manner that is counter productive to the protection of the handle. In fact, in a multiple axis vehicle crash, the inertia caused by a rollover crash, for example, may place the counter-mass in a position that permits the door to be unlatched and opened.

The present invention is directed at building on known door latching mechanisms and overcoming the above-mentioned limitations and drawbacks with respect to existing latching mechanisms and current protection technology.

SUMMARY OF THE INVENTION

The present invention is directed to a release handle having an integrated inertia locking mechanism that addresses the above-mentioned limitations with known release handle protection systems. The invention is particularly beneficial in acceleration events, such as a multiple axis crash, by counteracting the forces of inertia caused by such crash. In an exemplary aspect of the invention, the integrated inertia locking mechanism will prevent the latch mechanism, which releases the door, from releasing and the door opening during a multiple axis crash. After the crash, or when the crash force is removed, the integrated inertia locking mechanism of the invention will allow the latch mechanism to function normally, thereby permitting the door to be opened and the occupants to exit from the vehicle.

Other features and advantages of the invention will become apparent to those skilled in the art upon review of the following detailed description, claims and drawings in which like numerals are used to designate like features.

Figure 1:
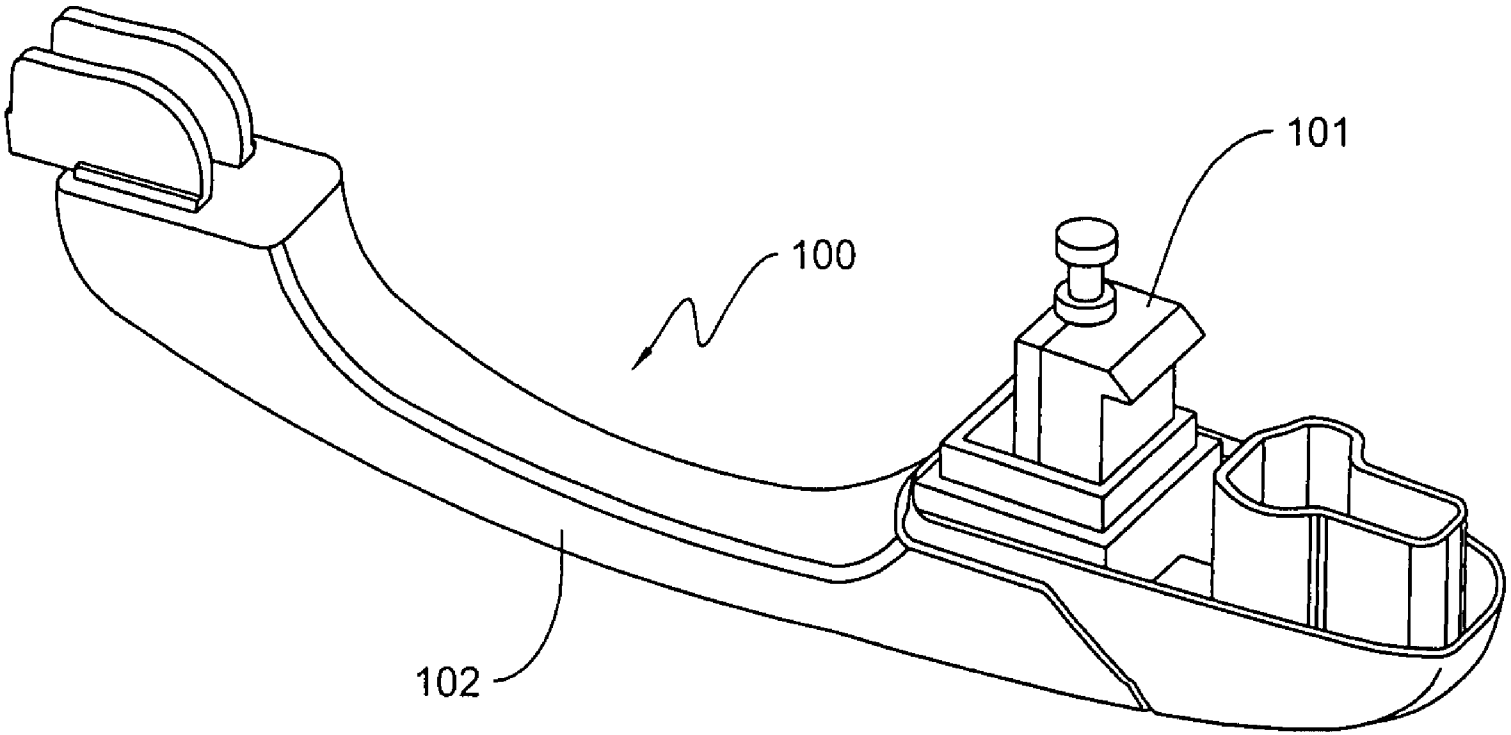
FIG. 1 shows a door handle assembly incorporating an integrated inertia locking mechanism assembly according to an embodiment of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE EMBODIMENTS

The present invention is directed to an inertia locking mechanism that may be used in any vehicle door handle assembly to counteract forces of acceleration or inertia caused by vehicle crashes, including multiple axis vehicle crashes. Referring to FIG. 1, an exemplary pull-style door handle assembly 100 is depicted that includes an inertia locking assembly 101, according to an embodiment of the invention, and a door handle 102. The inertia locking assembly 101 may be incorporated into a current production pull-style door handle with minimal or no changes to the surrounding environment, may be incorporated into a specially-designed door handle, or may be incorporated into any other known door handle. The inertia locking assembly 101 may be fully integrated into the handle component while not affecting or impeding the normal function of the handle component. The inertia locking assembly will take up significantly less space than other known protective devices.

In an exemplary embodiment, the inertia locking assembly 101 may control handle movement in a linear manner, in other words, in the same direction of movement as the release handle. As will be discussed below, the inertia locking assembly 101 causes the latching mechanism of door handle assembly to resist releasing of the door when a force is applied during a vehicle crash, including forces from a multiple axis crash, such as a rollover crash.

Figure 2:
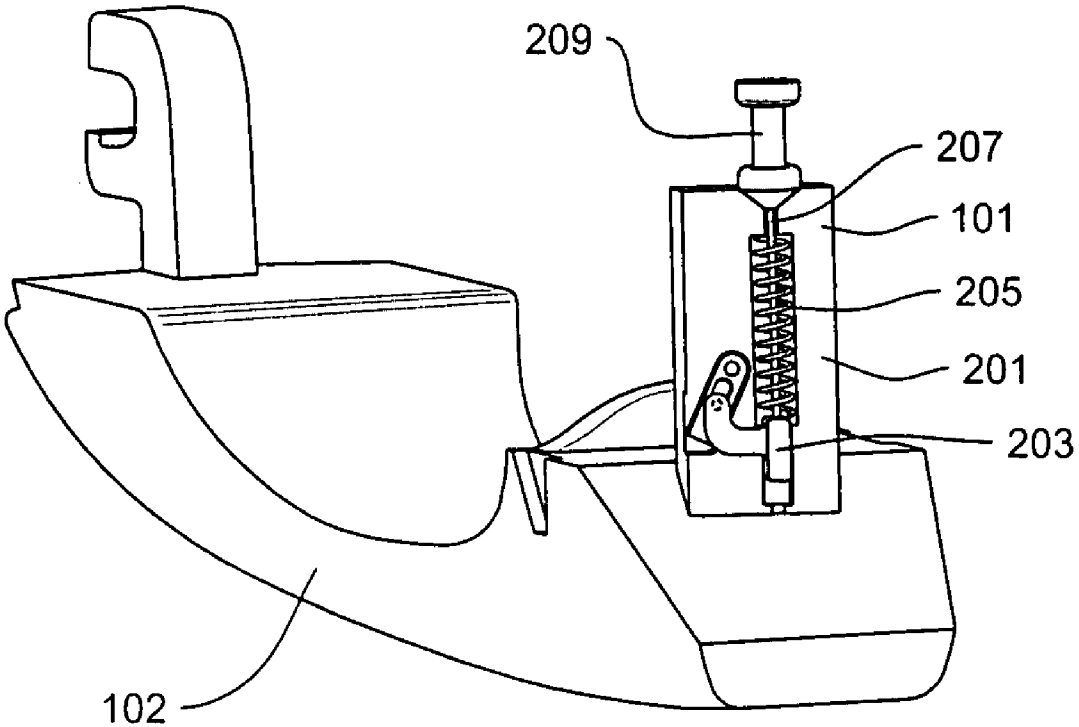
FIG. 2 shows a cut-away view of the integrated inertia locking mechanism of FIG. 1.
Figure 3:
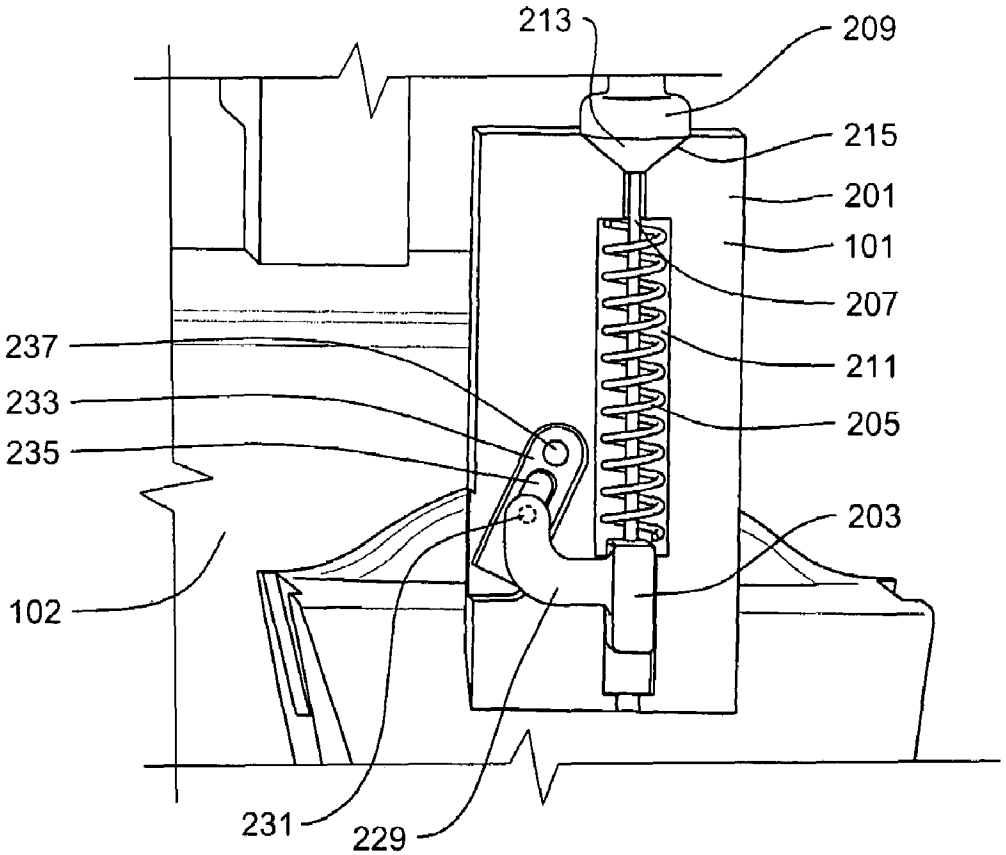
FIG. 3 shows an enlarged view of the integrated inertia locking mechanism depicted in FIG. 2.

Referring to FIGS. 2-3, the exemplary inertia locking mechanism 101 is further illustrated with one side of the housing removed to more clearly illustrate the components of the mechanism. As depicted, the locking mechanism 101 includes a housing 201, a locking tab or blade 203, a spring 205, a cable 207, and a weight component 209. The locking tab 203, cable 207, and weight component 209 may be individual components that are assembled together, or may be components that are molded together as a single unit. In the former configuration, locking tab 203 and weight component 209 may be crimped or otherwise secured onto opposing ends of the cable 207. In the latter configuration, the locking tab 203 and weight component 209 may be insert molded over the opposing ends of the cable 207 so that these components may be removed from the mold when assembled together. These components whether molded or assembled together may be housed within the housing 201 that is disposed in the latch assembly body. It should be understood that the invention is not limited by the shape and configuration of the housing 201.

The weight component 209 may define a barbell shape configuration with a cone-shaped section 213 (FIG. 3) that approximately matches a cone-shaped hole 215 (FIG. 3) formed by the housing 201. The cone-shaped holed 215 and the mating cone-shaped section 213 of the weight component 209 will ensure that the weight component 209 moves during a crash and will help protect the cable 207 from wear. As more clearly shown in FIG. 3, the housing 201 may include a slot 211 for receiving the locking tab 203, spring 205, and cable 207.

The cable 207 may be made of a flexible material and may be attached to both the locking tab 203 and the weight component 209. In an exemplary embodiment, the locking tab 203 and weight component 209 is insert molded onto opposing ends of the cable 207. The cable 207 may be threaded through the spring 205. In an exemplary aspect, the spring 205 may be a coil spring or may be any other suitable biasing element.

Referring to FIG. 3, the locking tab 203 may be generally planar in shape and may define an integral molded lever arm 229 with a boss 231 extending outwardly from the lever arm. The boss 231 may be configured within and may slide along a slot 235 formed integral with a pivotal locking arm 233. The locking arm 233 may be assembled to the housing 201 at a pivot point 237 through the use of a pivot pin, or the like. The pivot point 237 permits rotational movement of the locking arm 233 about the pivot 237 between a first "at rest" position and a second extended position. The operation and function of the exemplary locking mechanism is described below.

Figure 4:
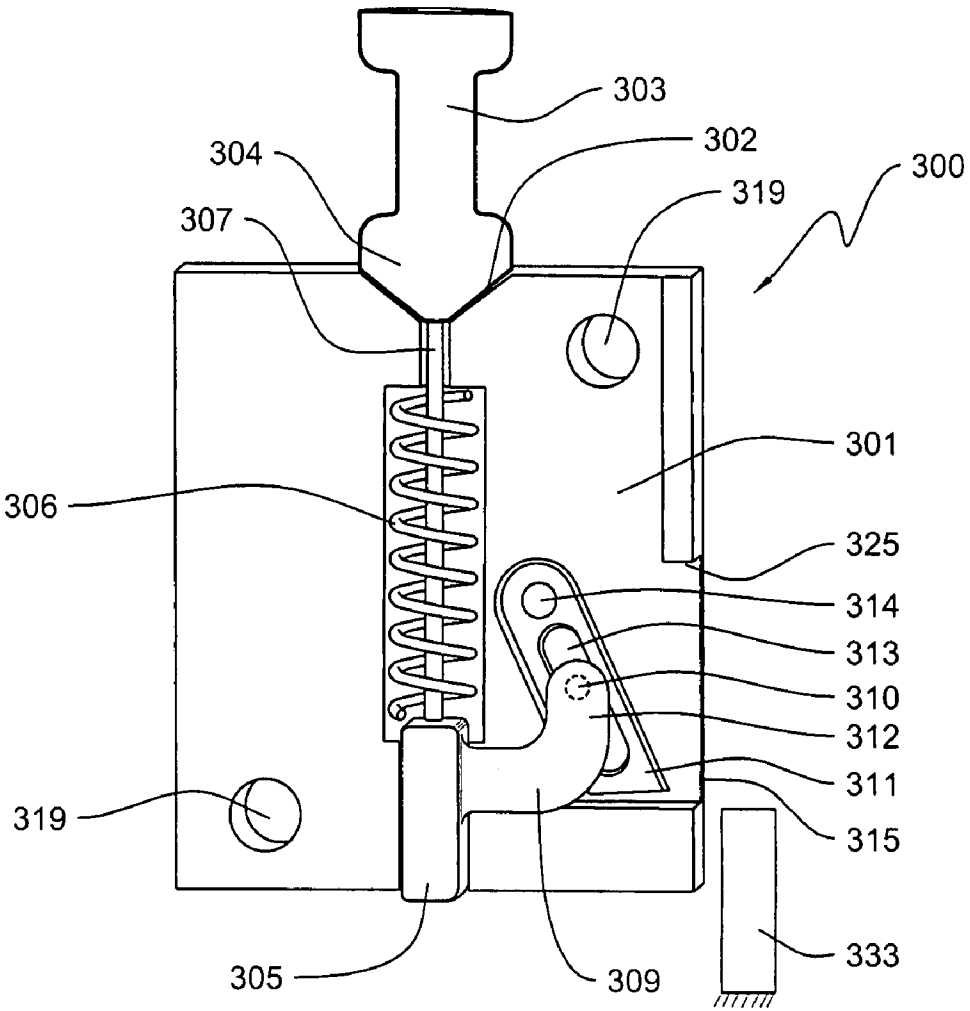
FIG. 4 shows another exemplary inertia locking mechanism to illustrate the locking mechanism in a first position.

Referring to FIG. 4, another exemplary embodiment of an inertia locking mechanism 300 is depicted. For clarification purposes, the inertia locking mechanism 300 is shown unattached to the handle. In one aspect of the embodiment, the inertia locking mechanism 300 may include a housing 301 that may be molded as part of the pull handle. Similar to the above embodiment, a weight component 303 defining a barbell shape and a locking tab or blade 305 may be molded onto a cable 307. The barbell shape weight component may define a cone-shaped section 304 and may further define a mass that may be placed onto the cable 307 and clamped to the cable prior to molding of the barbell shape of the weight component 303. In this configuration, the weight component would then be molded around both the cable and the mass thereby locking the mass onto the cable and defining the barbell shape at the same time. Alternatively, the barbell shaped weight component 303 may itself function as the mass. In this alternative aspect, the barbell shaped weight component may be produced from a high specific gravity resin. An example of such a resin is the GraviTech™ resin produced by PolyOne. This exemplary resin uses a blend of very high specific gravity metals with injection moldable polymers resulting in a high specific gravity (high mass) resin for injection molding. The resin would have a sufficient mass to allow the barbell shaped weight component 303 to function as the counterweight with the invention.

Similar to the above embodiment, a spring 306 may be placed onto the cable 307 between the weight component 303 and the tab 305. The spring 306 may be placed onto the cable 307 prior to molding the weight component 303 and tab 305 to the cable 307. Alternatively, the spring 306 may be threaded onto the cable 307 after the aforementioned molding process. The cable 307 may be made of a variety of materials including steel wire or plastic.

Similar to the above embodiment, the tab 305 may define an integral molded lever arm 309 with a boss 310 extending outwardly from end 312. The boss 310 may extend toward the housing 301 and may engage a slot 313 formed integral with a locking arm 311. The locking arm 311 with the integral slot 313 may define a pivot point 314. The locking arm 311 may be assembled to the housing 301 at the pivot point through the use of a pivot pin. A cover or cap (not shown) may be positioned over the weight component/tab/cable/spring sub-assembly to enclose these components within the housing 301. The cover or cap may be attached to the housing 301 by a variety of means including but not limited to welding, heat staking, or fasteners. The cover may be assembled to the housing 301 at attachment points 319. The cover or cap may also act as a functional part of the handle assembly in that it may interface with other movable portions of the entire release handle assembly, for example, the cover may be the contact point for the rotating lever arm attached to the latch rod or latch cable of the door latching mechanism—components of a door latch assembly as understood in the art.

The housing 301 may define an aperture 302 that is cone-shaped to match the cone-shaped portion 304 of the weight component 303. The housing 301 may also define an opening 315 that will allow the locking arm 311 to protrude from the handle and housing 301 when actuated, as explained below. The cover (not shown) may also contain an opening corresponding to opening 315 in the housing 301. Again, as with the above embodiments, the configuration of the housing may vary.

It should be understood that while the weight component and tab are shown aligned with each other (FIG. 4), the weight component 303 and tab 305 may be configured such that they are not aligned. For example, it is possible that the weight component 303 and tab 305 may be routed by features in the housing 301, such as with a pulley mechanism. Alternatively, the weight component 303 and tab 305 may be offset at a desired angle to tailor the performance and reaction characteristics of the entire locking mechanism.

In the normal operation of pulling the handle to release the latch and thereby open the vehicle's door, the components of the inertia locking mechanism 101 and 300 do not move and therefore do not impede movement of the door handle assembly. In the event of a high acceleration event, such as a vehicle rollover, the inertia locking mechanism 101 and 300 will impede movement of the door handle assembly. Although the operation of the inertia locking mechanism 101 and 300 are similar, for discussion purposes, the operation of the inertia locking mechanism 300 under a high acceleration event will be described with reference to FIG. 5.

Figure 5:
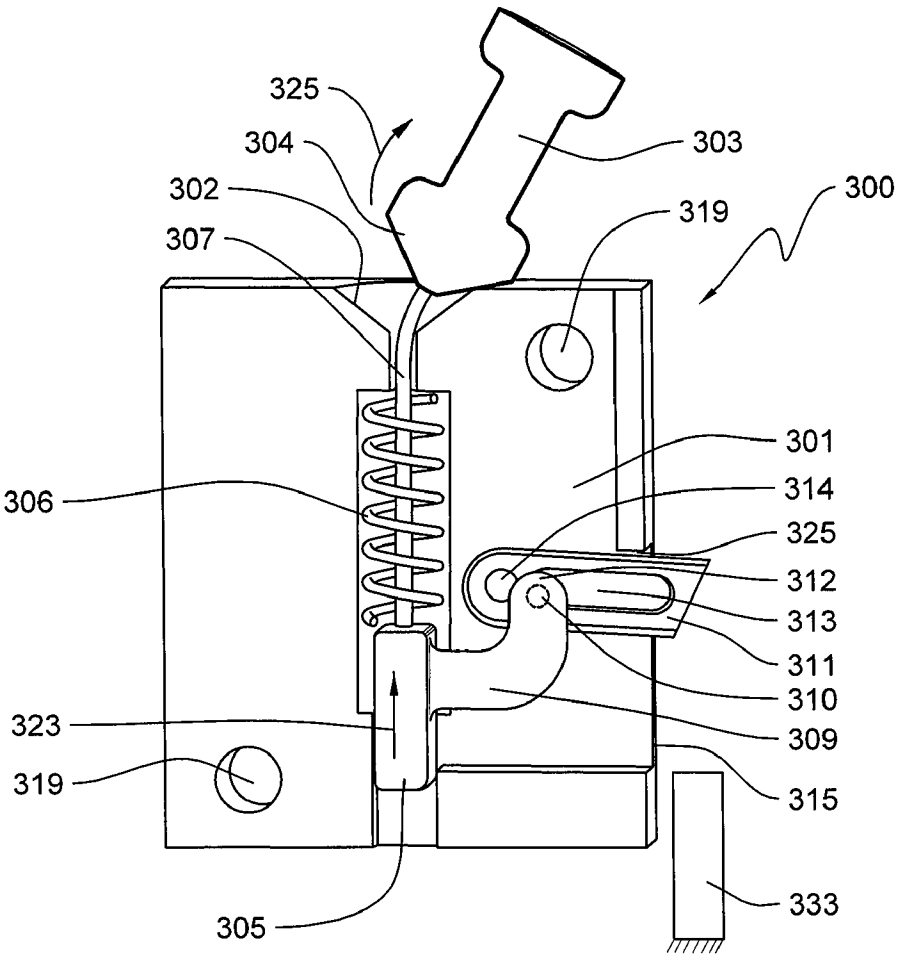
FIG. 5 shows the exemplary inertia locking mechanism of FIG. 4 in a second position.

Referring to FIG. 5, the inertia locking mechanism assembly may be integrated to the handle therefore forces due to an impact/crash are translated directly to the device housing 301. As the housing 301 is accelerated (due to the crash impact) the weight component 303 begins to deflect in a direction outward and away from the housing as indicated by direction arrow 325 and rotate from its "at rest" position. The "at rest" position is depicted in FIG. 4. This deflection causes the tab 305 to move in the direction indicated by direction arrow 323. Prior to this deflection, the inertial properties of the weight component, i.e., its mass, center of mass, and geometric shape, cause the weight component to want to stay at rest as the handle assembly and housing 301 is moving with the vehicle structure. However, in the event of a crash, the inertial "at rest" tendencies are overcome and the weight component will move away from the "at rest" position, will overcome the spring force exerted by spring 306, and will pull on the cable 307 which is attached to the tab 305, thereby deflecting the tab as indicated by direction arrow 323. The lever arm 309 and boss 310, because they are part of the tab 305, will also deflect or move when the tab 305 deflects or moves. The movement of the lever arm 309 with the boss 310 operatively connected to the slot 313 of the locking arm 311 causes a proportional swinging movement of the locking arm 311. The locking arm 311 with the integral slot 313 pivots about the pivot point 314 and moves because the boss lever arm 309 contacts the inside of the slot 313 and moves the arm upward. As the locking arm 311 pivots upward it protrudes from the opening 315 in the housing 301 and cover (not shown). The locking arm 311 will pivot upward to a predetermined maximum point, e.g., a second position, where the locking arm 311 will make contact with a hard stop point 325 on the housing 301. As the forces from the crash impact cause the handle to begin to open, the protruding locking arm 311 will make contact with a non-movable part of the handle assembly, generally depicted as item 333. The locking arm 311, because it is an integrated part of the movable handle, will prevent the movable handle from opening to a sufficient point to actuate the door latch, therefore preventing inadvertent opening of the door handle during a crash. After the crash impact event is over and the forces and/or accelerations have subsided, the inertia locking mechanism 300 will return to an unlocked free state. This is achieved by the force of the spring 306 which urges the tab 305 in the direction opposite the direction arrow 323. This will in turn cause the lever arm 309 to pull on the locking arm 311 which will cause the locking arm 311 to pivot back into the housing 301 through the opening 315. This unlocking action makes it possible for the door handle to be operated normally after the inertia locking mechanism 300 has operated during the high acceleration event or crash.

Figure 6:
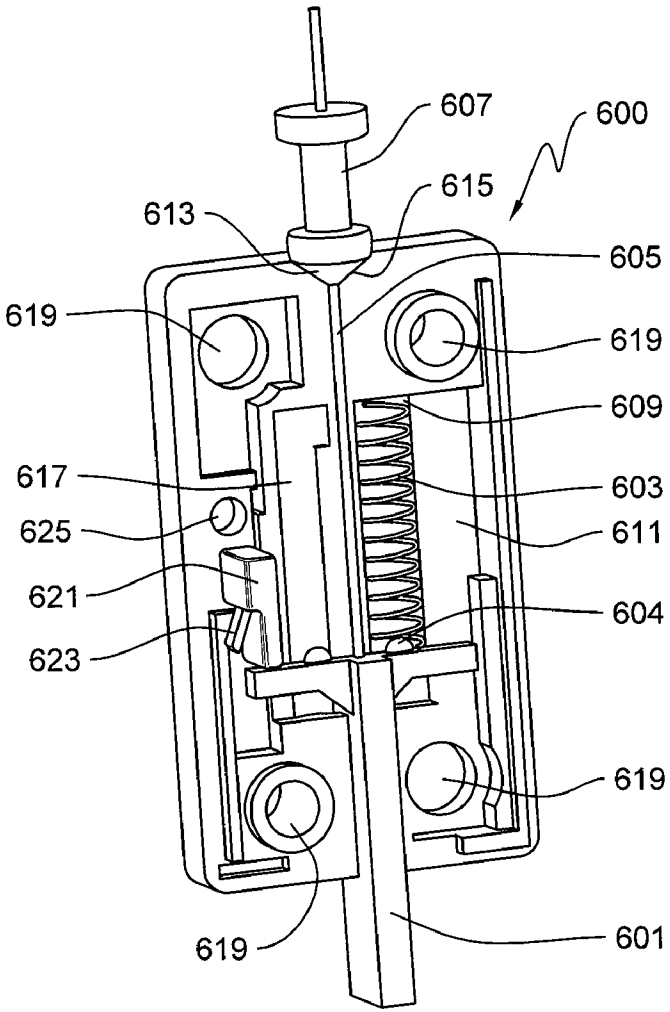
FIG. 6 shows an inertia locking mechanism according to another embodiment of the invention.

Referring to FIG. 6, there is depicted an inertia locking mechanism 600 according to another embodiment of the invention. The inertia locking mechanism 600 includes a locking blade or tab 601, a barbell-shaped weight portion 607 connected to the locking blade or tab 601 by a cable 605. Rather than the spring positioned over the cable as described above, a spring 603 may be place along side the cable 605 in a slot 609 formed in a housing 611. The slot 609 may be configured substantially parallel to and next to the cable 605. The spring 603 will function in a substantially similar manner as previously described by making contact with the housing 611 and the tab 601 to perform the return function of the tab 601 after actuation of the locking mechanism. Additionally, this alternative embodiment provides the optional use of a spring-type member other than a normal compression spring. In yet another alternative aspect, a dampening device may be integrated into the slot 609 or on any other part of the housing or locking mechanism 600 to control or slow the returning action of the mechanism 600 to the start position.

As shown in FIG. 6, the spring 603 may be positioned on a spring seat 604 located on the tab 601. Similar to the other embodiments, the barbell-shaped weight portion 607 has a cone-shaped section 613 that approximately matches a cone-shaped hole 615 that is formed by the housing 611. Also similar to the above embodiments, the locking tab 601 and barbell-shaped weight portion 607 may be insert molded over the cable 605 so that these components may be removed from the mold when assembled together. With this embodiment, assembly is improved in that the spring 603 no longer needs to be placed over the cable prior to molding of the barbell-shaped weight portion 607 and locking tab 601 onto the cable 605, or threaded onto the cable. Also with this embodiment, different types of springs may be used, other than the depicted coiled spring. This will permit greater flexibility in the use of spring type members to provide the desired level of spring-type resistance and response.

A second slot 617 may be configured in the housing 611 on the side opposite the slot 609. The second slot 617 may permit the placement of the spring 603 at this location in the housing. Alternatively, the second slot 617 may permit the placement of a second spring in the housing depending on the desired level of spring-type resistance and response.

The housing 611 may comprise two housing halves, though only one half is shown in FIG. 6. Each housing half may have mounting holes 619 that permit the two housing halves to be joined together and to other structures through the use of fasteners, staking or the like. The components of the inertia locking mechanism 600 are placed in one of the housing halves and the other housing half is placed over to form the housing 611. Additionally, both housing halves are substantially the same and interchangeable.

The inertia locking mechanism 600 may function in a manner similar to the embodiment described above. That is, during non-crash conditions, the weight portion 607 may seat in the mating opening 615 in the housing 611. During a crash condition, as the weight 607 moves away from the housing 611, the weight which is connected to the locking tab 601 via the cable 605 will pull the locking tab 601 causing the locking tab 601 to move and engage a moveable portion of the door handle assembly (not shown) or other movable components of the latch release system (not shown), thereby preventing motion of these movable components and thus preventing the door from opening during a crash. When the crash condition is over, the spring force of the spring 603 causes the locking tab 601 to return to its home or "at rest" position thus permitting normal operation of the door handle or latch release system and thus permitting the door to be opened.

Referring to FIG. 6, in an alternative aspect, a sliding indicator 621 may be incorporated into the inertia locking mechanism 600. The sliding indicator 621 may be operatively positioned in contact with locking tab 601. When the locking tab 601 is moved into the locked or actuated position, the locking tab pushes the sliding indicator 621 upward. The upward motion of the sliding indicator 621 may be guided by an integral slot formed in the housing 611. The sliding indicator 621 contains an integral locking arm portion 623, as shown in FIG. 6 as protruding from the side of sliding indicator 621. The locking arm portion 623 may retain the sliding indicator 621 in an upward position of its movement after the sliding indicator is moved to the upward position by the motion of the locking tab 601, and after the locking tab returns to its home or "at rest" position. In an exemplary aspect, the sliding indicator 621 may be visible through a small hole 625 formed in the housing 611, as depicted in FIG. 6.

With this exemplary embodiment, the inertia locking mechanism 600 could then be inspected after the crash event and the inspector would be able to identify if the inertia locking mechanism actuated or locked based on the post-crash position of the sliding indicator 621. It should be understood that the sliding indicator 621 may be produced from variety of materials or colors to enhance its performance and visibility.

There are numerous advantages of the exemplary inertia locking mechanisms described above. For example, the inertia locking mechanisms may be integrated into the door handle, thereby creating a very compact package. The embodiments described herein provide for protection for accelerations in any direction and the level of protection increases as the acceleration forces increase. The inertia locking mechanisms are highly tunable to different applications and forces and eliminate the need for large counterweights. The teachings of the inventions may reduce the overall cost in some vehicle door systems and may permit the use of a lighter handle return spring (a tactile and ergonomic advantage) and may further permit the use of larger release handles. Additionally, the inertia locking mechanisms also allow normal operation of the door handle after a crash impact.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An inertia locking mechanism, the inertia locking mechanism coupled to a handle of a door handle assembly in a door of a vehicle, comprising:

a housing defining an opening;

a weight component mounted to the housing, that is displaced when a crash force is applied to the weight component, and that returns to a home position when the crash force is removed, wherein the crash force results from a crash of the vehicle;

a locking tab that defines a lever arm;

a cable that attaches to the weight component at one end and to the locking tab at the other end and that causes movement of the locking tab when the weight component is displaced;

a spring positioned in the housing that retrains the weight component from moving when the crash force is not applied; and a locking arm operatively connected to the lever arm, wherein the weight component will be moved by the crash force, thereby moving the lever arm to cause the locking arm to move through the opening in the housing to extend outside the housing, so that when the handle is moved to a certain point by the crash force, the locking arm will engage a non-movable member of the door handle assembly to prevent the handle from further opening to therefore prevent inadvertent opening of the door during the crash.

2. The inertia locking mechanism of claim 1, wherein the housing defines an aperture that further defines a cone-shaped surface and wherein the weight component has a cone-shaped section.

3. The inertia locking mechanism of claim 1, wherein the lever arm further defines a boss.

4. The inertia locking mechanism of claim 3, wherein the locking arm further defines a slot for receiving the boss of the lever arm.

5. The inertia locking mechanism of claim 4, wherein the locking arm is pivotal between a first position and a second position.

6. The inertia locking mechanism of claim 5, wherein the spring is positioned on the cable.

7. The inertia locking mechanism of claim 5, wherein the locking arm pivots to the second position when a crash force is applied to the weight component and wherein the locking arm pivots to the first position when the crash force is removed.

8. The inertia locking mechanism of claim 1, wherein the spring comprises a coil spring.

9. The inertia locking mechanism of claim 7, wherein the locking arm engages the non-movable member when the locking arm pivots to the second position.

10. The inertia locking mechanism of claim 7, wherein the spring urges the weight component to the home position when the crash force is removed.

11. The inertia locking mechanism of claim 1, wherein the weight component comprises a barbell-shaped portion and a mass.

12. An inertia locking assembly that resists unlatching of a door of a vehicle during a crash, comprising:

a housing defining a hole, the housing adapted to be mounted to a door handle;

a weight component;

a cable connecting the weight component to a locking tab, the locking tab defining a lever arm, the cable extending through the hole;

a spring that restrains the weight component in a home position; and a locking arm pivotally mounted to the housing and operatively connected to the lever arm, whereby a crash force caused by a crash causes movement of the weight component from the home position away from the housing, wherein the movement of the weight component which causes movement of the lever arm which in turn causes the locking arm to pivot, so that the locking arm is positioned to engage a non-movable member of the door handle, when the handle is moved to a certain position by the crash force to prevent the door from unlatching during a crash.

13. The inertia locking assembly of claim 12, wherein the lever arm further defines a boss.

14. The inertia locking assembly of claim 12, wherein the locking arm further defines a slot for receiving the boss of the lever arm.

15. A door mechanism that resists unlatching of a vehicle door during a crash, comprising:

a door handle assembly further comprising a door handle;

an inertia locking assembly further comprising:

a housing attached to the door handle, the housing including a hole;

a weight component that is permitted to travel in the hole, wherein the weight component is displaced from a home position when a force is applied to the weight component;

a spring that restrains the weight component in the home position when the force is not applied;

a locking tab operatively connected to a pivoting locking arm; and a cable that attaches to the weight component and to the locking tab, wherein when the force is applied to the weight component to cause the weight component to move away from the home position, the weight component moves the cable which causes the locking tab to move the locking arm so that the locking arm pivots to enable engagement with a non-movable member of the door handle assembly after the door handle has moved to a certain point by the force, to thereby prevent the door handle from further movement and from opening the door.

16. The door mechanism of claim 15 wherein the door handle is a pull-type door handle.

17. The door mechanism of claim 15 wherein the locking tab further defines a lever arm that defines a boss.

* * * * *

UNITED STATES PATENT AND TRADEMARK OFFICE

CERTIFICATE OF CORRECTION

PATENT NO. : 7,635,151 B2
APPLICATION NO. : 11/449224
DATED : December 22, 2009
INVENTOR(S) : Rodawold, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 175 days.

Signed and Sealed this

Ninth Day of November, 2010

David J. Kappos

David J. Kappos
*Director of the United States Patent and Trademark Office*